United States Patent [19]

Weinerman et al.

[11] Patent Number: 4,969,916

[45] **Date of Patent: * Nov. 13, 1990**

[54] LATCH AND LOCK ASSEMBLIES WITH SPRING-BIASED PIVOT BOLTS

[75] Inventors: Lee S. Weinerman, Medina; Steven A. Mayo, Akron; Joel T. Vargus, Parma, all of Ohio; Thomas V. McLinden, Oxford; Timothy H. Wentzell, South Windsor, both of Conn.

[73] Assignee: The Eastern Company, Cleveland, Ohio

[ * ] Notice: The portion of the term of this patent subsequent to Jul. 25, 2006 has been disclaimed.

[21] Appl. No.: 327,545

[22] Filed: Mar. 23, 1989

Related U.S. Application Data

[63] Continuation-in-part of Ser. No. 72,174, Jul. 10, 1987, Pat. No. 4,850,208, which is a continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[5] ..... E05B 13/10

[52] U.S. Cl. ..... 70/208; 70/83; 70/210; 292/227; 292/DIG. 31

[58] Field of Search ..... 70/81, 83, 84, 208–210, 70/431, 451, 466, 483–485, 489; 292/198, 210, 224, 227, 228, 164, 240–242, DIG. 31, DIG. 37, DIG. 63; 411/129–132, 533, 432, 368, 369

[56] References Cited

U.S. PATENT DOCUMENTS

| | | | |
|---|---|---|---|
| Re. 14,741 | 10/1919 | Anderson | 292/198 |
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 791,258 | 5/1905 | Ford | 411/130 |
| 824,330 | 6/1906 | Barnard | 411/131 |
| 1,995,106 | 3/1935 | Roedding | 292/226 |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |

(List continued on next page.)

OTHER PUBLICATIONS

Southco Inc., Southco Fasteners Handbook 37, Concordville, PA 19331, Date Unknown.

Eberhard Manufacturing Co., *Handbook of Latches, Locks, Hinges, Handles, and Related Hardware.* No. 103, Cleveland, OH 44136, 1985.

*Primary Examiner*—Robert L. Wolfe
*Assistant Examiner*—Suzanne L. Dino
*Attorney, Agent, or Firm*—David A. Burge

[57] ABSTRACT

Flush mountable latches and locks for industrial cabinets, tool carts, electrical equipment enclosures and the like utilize versatile housings of novel configuration together with push-to-operate handles that are pivotally movable relative to the housings to effect unlatching movements of spring-biased, pivotally mounted latch bolts. The lock-type embodiment has a locking mechanism that is mounted on the housing to selectively permit and prevent unlatching movements of its pivotal latch bolt. The resulting arrangement provides sturdy latch and lock assemblies that employ a small number of relatively movable parts that can be assembled, installed and serviced with ease. Improved features include the provision of a plural part handle assembly having portions that are configured to cooperate with a resilient, weather resistant boot that optionally may be interposed between housing and handle assembly components. Other improvements features include the provision of mounting hardware that readily adapts latch and lock units for mounting on structures of a wide variety of thicknesses, and simplifications that enhance the ease of assembly and improve the operation of components that are employed in the lock-type embodiment.

21 Claims, 7 Drawing Sheets

U.S. PATENT DOCUMENTS

| | | | |
|---|---|---|---|
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 3/1955 | Tatom | 16/147 |
| 2,721,751 | 10/1955 | Holritz | 292/169 |
| 2,735,706 | 2/1956 | Pelcin | 282/34 |
| 2,746,784 | 3/1956 | Holritz | 292/175 |
| 2,763,503 | 9/1956 | Tasch et al. | 292/173 |
| 2,773,376 | 12/1956 | Wartian | 70/150 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,872,241 | 2/1959 | Shelden | 296/65 |
| 2,900,204 | 8/1959 | Pelcin | 292/173 |
| 2,916,905 | 12/1959 | Podlesak | 70/150 |
| 2,924,478 | 2/1960 | Wartian | 292/224 |
| 2,952,150 | 9/1960 | Matzkin et al. | 70/451 |
| 2,962,320 | 11/1960 | Gilbert | 292/337 |
| 2,987,908 | 6/1961 | Pelcin | 70/146 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/140 |
| 3,161,923 | 12/1964 | Crain | 20/52 |
| 3,190,334 | 6/1965 | Wigam | 411/131 |
| 3,208,781 | 9/1965 | Appleberry | 292/128 |
| 3,209,563 | 10/1965 | Pelcin | 70/146 |
| 3,209,564 | 10/1965 | Pelcin | 70/148 |
| 3,240,523 | 3/1966 | Heimann | 292/198 |
| 3,338,610 | 8/1967 | Pelcin et al. | 292/126 |
| 3,351,116 | 11/1967 | Madsen | 411/131 X |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/336.3 |
| 3,550,412 | 12/1970 | Pitel et al. | 70/461 |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,767,244 | 10/1973 | Plaw | 292/227 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,871,198 | 3/1975 | Miller | 70/146 |
| 4,021,073 | 5/1977 | Manning | 296/137 |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 70/472 |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,365,831 | 12/1982 | Bourne | 292/229 |
| 4,370,874 | 2/1983 | Munn | 70/204 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 244/75 |
| 4,492,394 | 1/1985 | Dignan | 292/64 |
| 4,496,261 | 1/1985 | Cohen et al. | 411/368 X |
| 4,498,319 | 2/1985 | Balducci et al. | 70/92 |
| 4,510,779 | 3/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 70/169 |
| 4,679,835 | 7/1987 | Weinerman et al. | 292/197 |
| 4,683,736 | 8/1987 | Weinerman et al. | 70/208 |
| 4,684,281 | 8/1987 | Patterson | 411/129 X |
| 4,693,503 | 9/1987 | Bisbing | 292/210 |
| 4,706,478 | 11/1987 | Swan et al. | 70/208 |
| 4,707,006 | 11/1987 | Garg et al. | 292/336.3 |
| 4,850,208 | 7/1989 | Weinerman et al. | 70/208 |

LATCH AND LOCK ASSEMBLIES WITH SPRING-BIASED PIVOT BOLTS

CROSS-REFERENCE TO RELATED APPLICATIONS

The present application is a continuation-in-part of a co-pending application entitled LATCH AND LOCK ASSEMBLIES WITH SPRING-BIASED PIVOT BOLTS, Ser. No. 072,174, now U.S. Pat. No. 4,850,208, filed July 10, 1987 by Lee S. Weinerman et al (referred to hereinafter as the "Predecessor Case"), which application was filed as a continuation-in-part of a prior application entitled CABINET LOCK WITH RECESSED HANDLE, Ser. No. 859,194 filed Apr. 28, 1986 by Lee S. Weinerman et al that issued Aug. 4, 1987 as U.S. Pat. No. 4,683,736, which prior application was filed as a continuation-in-part of an earlier application Ser. No. 601,648 filed Apr. 18, 1984 (now abandoned), with said prior and earlier applications being referred to hereinafter as the "Parent Cases," and with the disclosures of all of the Parent and Predecessor Cases being incorporated herein by reference.

Reference also is made to the following applications that were filed concurrently with said Predecessor Case, the disclosures of which are incorporated herein by reference:

LATCH AND LOCK HOUSINGS, HANDLES AND MOUNTING BRACKETS, Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

LATCH AND LOCK ASSEMBLIES WITH SPRING-BIASED SLIDE BOLTS, Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

LATCH AND LOCK ASSEMBLIES WITH LIFT AND TURN HANDLES, Ser. No. 072,175, filed July 10, 1987 by Lee S. Weinerman, Frank R. Albris, Thomas V. McLinden and Timothy H. Wentzell, hereinafter referred to as the "Utility Case IV;"

LATCH AND LOCK ASSEMBLIES WITH EXPANSIBLE LATCH ELEMENTS, Ser. No. 072,250, filed July 10, 1987 by Lee S. Weinerman, Steven A. Mayo, Thomas V. McLinden and Timothy H. Wentzell, hereinafter referred to as the "Utility Case V;"

HOUSINGS FOR LATCHES AND LOCKS, Ser. No. 072,282, filed July 10, 1987 by Richard H. Russell, David W. Kaiser and Richard M. O'Grady, hereinafter referred to as the "Design Case I;"

COMBINED HOUSINGS AND HANDLES FOR LATCHES AND LOCKS, Ser. No. 072,283, filed July 10, 1987 by Richard H. Russell, David W. Kaiser and Richard M. O'Grady, hereinafter referred to as the "Design Case II;"

COMBINED HOUSINGS AND HANDLES FOR LATCHES AND LOCKS, Ser. No. 072,285, filed July 10, 1987 by Richard H. Russell and David W. Kaiser, hereinafter referred to as the "Design Case III;"

COMBINED HOUSINGS AND HANDLES FOR LATCHES AND LOCKS, Ser. No. 072,284, filed July 10, 1987 by Richard H. Russell and David W. Kaiser, hereinafter referred to as the "Design Case IV;"

COMBINED HOUSINGS AND HANDLES FOR LATCHES AND LOCKS, Ser. No. 072,276, filed July 10, 1987 by Richard H. Russell and David W. Kaiser, hereinafter referred to as the "Design Case V;"

COMBINED HOUSINGS AND HANDLES FOR LATCHES AND LOCKS, Ser. No. 072,573, filed July 10, 1987 by Richard H. Russell and David W. Kaiser, hereinafter referred to as the "Design Case VI;"

COMBINED HOUSINGS AND HANDLES FOR LATCHES AND LOCKS, Ser. No. 072,277, filed July 10, 1987 by Richard H. Russell and David W. Kaiser, hereinafter referred to as the "Design Case VII;"

MOUNTING BRACKETS FOR LATCHES AND LOCKS, Ser. No. 072,278, filed July 10, 1987 by Richard H. Russell and Thomas V. McLinden, hereinafter referred to as the "Design Case VIII;"

MOUNTING BRACKETS FOR LATCHES AND LOCKS, Ser. No. 072,280, filed July 10, 1987 by Richard H. Russell and Thomas V. McLinden, hereinafter referred to as the "Design Case IX;"

STRIKERS FOR USE WITH LATCHES AND LOCKS, Ser. No. 072,279, filed July 10, 1987 by Lee S. Weinerman and Steven A. Mayo, hereinafter referred to as the "Design Case X;" and, STRIKERS FOR USE WITH LATCHES AND LOCKS, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize a highly versatile housing together with other interactive components of novel form to provide desired types of latching and locking actions.

2. Prior Art

Flush mounted latches and locks including a body, a latch bolt movably carried on the body, and an operating handle that is nested by the body are well known. Normally the handle is in a flush or nested position when the bolt is in a latched position; and unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pat. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to the Eastern Company, a corporation of Conn.

Flush mounted latches and locks having latch bolts of other than the spring-projected, slide-mounted type are disclosed in such U.S. Pat. Nos. as 4,413,849, 4,320,642, 4,312,203, 4,134,281, 3,857,594, 3,338,610, 3,044,814, 3,044,287 and 2,735,706, all of which are assigned to the Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

3. The Cross-Referenced Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is reflected in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Predecessor Case

Because the best mode known to the inventors for carrying out the practice of the present invention is in conjunction with the basic type of latch and lock units that are disclosed in the referenced Predecessor Case, the text of the present case tracks quite closely the text of the Predecessor Case, and the drawings that are included herewith follow in the basic format and arrangement of the drawings of the Predecessor Case. Likewise, many of the claims that follow build upon claims that have have been allowed in the Predecessor Case.

5. The Referenced Parent Cases

The lock-type embodiment that is disclosed in the referenced Predecessor Case makes use of a key cylinder retaining means that also is disclosed in the referenced Parent Cases. This fact explains, at least in part, why the Predecessor Case was filed as a continuation-in-part of the referenced Parent Cases.

However, in the preferred practice of the present invention, the means by which key cylinders and the like are retained in their associated lock housings has been changed, resulting in a simplification of the construction of the lock-type embodiment, and in enhanced ease of assembly. Thus, the referenced Parent Cases are not as relevant to the invention of the present case as they were to the Predecessor Case.

SUMMARY OF THE INVENTION

The present invention provides novel and improved flush mountable latches and locks for industrial cabinets, tool carts, electrical equipment enclosures and the like, with the latches and locks utilizing a highly versatile housing together with other interactive components of novel form to provide desired types of latching and locking actions.

While the inventive features that form the subject matter of the present case are primarily intended for use as "improvements" in conjunction with the invention that forms the subject matter of the referenced Predecessor Case, it will be understood by those skilled in the art that a number of the improvement features that are described herein can be utilized with other forms of latch and lock structures, most especially those that are disclosed in the several referenced Utility and Design Cases which were filed July 10, 1987.

The inventive features that form the subject matter of the present application include improvements that enhance the ease with which latch and lock units of the basic type that are described in the referenced Predecessor Case can be fabricated and assembled, facilitate the optional addition to such latch and lock units of weatherproofing boot-type seals that may be interposed between housing and operating handle components, and enhance the ease with which such latch and lock units can be mounted on structures of a variety of thicknesses. Also, improvements are disclosed that enable components of such lock-type units to be assembled with greater ease, utilizing a smaller number of locking components that cooperate in advantageous ways to yield improvements in performance.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
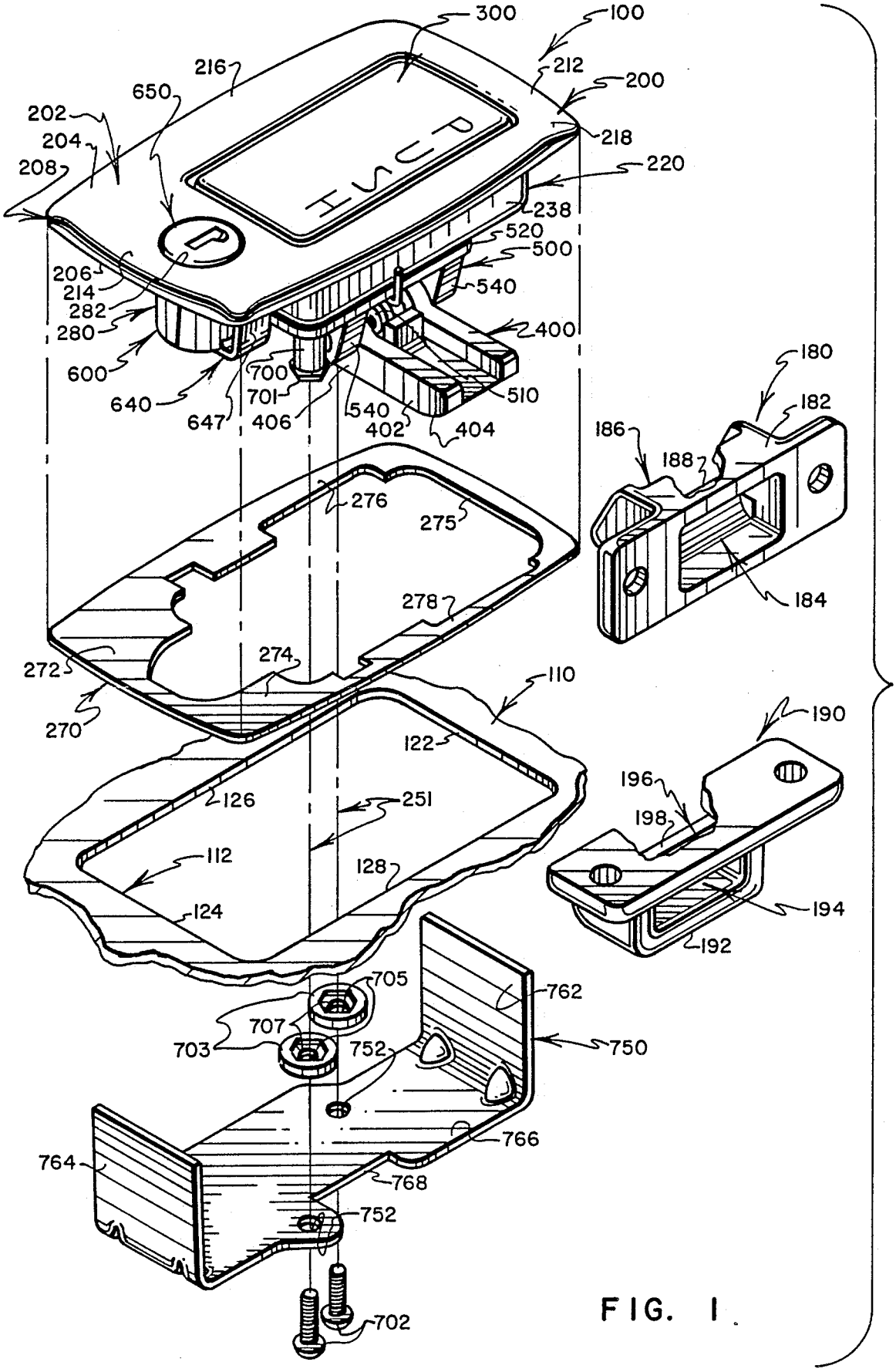
FIG. 1 is an exploded perspective view of one form of lock assembly that embodies features of the preferred practice of the present invention, illustrating how the lock assembly is mounted on a closure, and showing two types of strikers that may be used with the lock assembly, with front surface portions of the strikers being broken away.

Referring to FIG. 1, one form of a snap-acting lock assembly that embodies features of the preferred practice of the present invention is indicated generally by the numeral 100. The lock assembly 100 has a housing 200 that mounts a plurality of interactive components that provide latching and locking functions.

In overview, and as will be explained in greater detail, the interactive components that are carried on the housing 200 principally include a handle assembly 300 that is mounted on the housing 200 for movement between normal and operating positions; a spring-pivoted latch bolt 400 that is mounted on the housing 200 for movement between latched and unlatched positions; a bracket and spring assembly 500 that mounts the latch bolt 400 on the housing 200 for movement between latched and unlatched positions, with movements of the latch bolt 400 to its unlatched position taking place in response to movement of the handle assembly 300 to its operating position; and, a locking mechanism 600 for selectively permitting and preventing unlatching movement of the latch bolt 400 by the handle assembly 300. If the locking mechanism 600 is omitted, the lock assembly 100 is thereby transformed into a latch assembly, i.e., a unit which has a handle assembly 300 that always can be operated to retract the latch bolt 400.

Referring to FIG. 1, it will be seen that the latch bolt 400 projects relatively sidewardly with respect to the housing 200 for engaging a suitably configured striker such as the strikers 180, 190 that are depicted in FIG. 1; however, those skilled in the art will understand that other types of strikers, as well as keeper formations of conventional, commercially available configurations, also may be used to engage and releasably retain the latch bolt 400.

The strikers 180, 190 have body structures 182, 192 that surround and define bolt-receiving chambers 184, 194, respectively. Openings 186, 196 are formed in the body structures 182, 192 and communicate with the chambers 184, 194, respectively. The openings 186, 196 are of adequate size to receive and releasably retain a tip portion of the latch bolt 400. Latch bolt engagement surfaces 188, 198 extend along one side of their associated openings 186, 196. Appearance features of the striker 180 are disclosed in greater detail in the referenced Design Case X. Appearance features of the striker 190 are disclosed in greater detail in the referenced Design Case XI.

Figure 2:
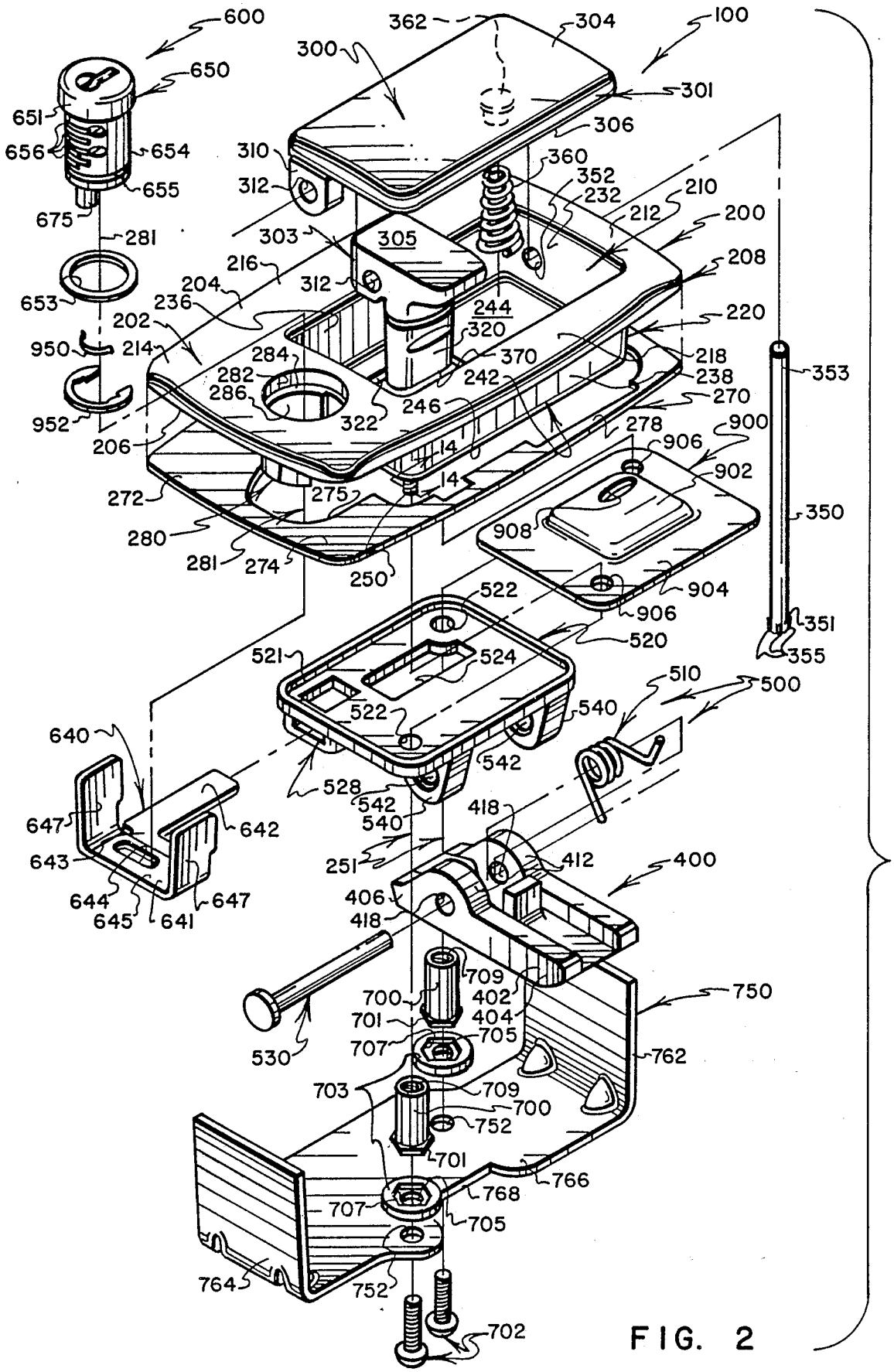
FIG. 2 is an exploded perspective view of components of the lock assembly of FIG. 1.
Figure 3:
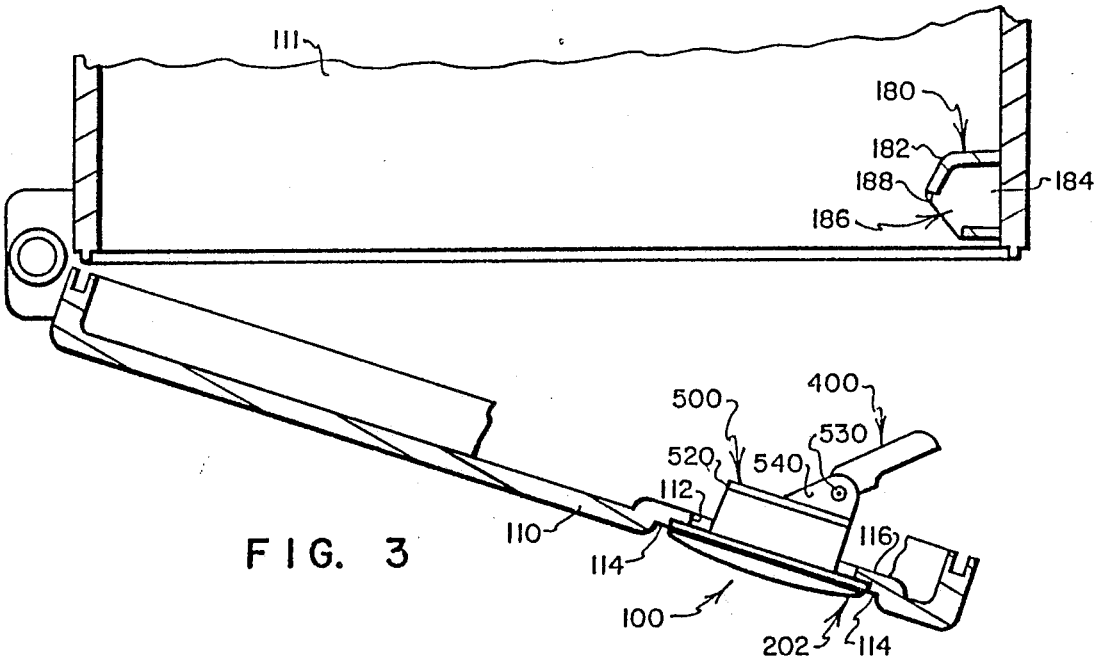
FIG. 3 is a schematic top plan view, on a reduced scale, showing the lock assembly of FIG. 1 installed on a pivotal closure, with a striker shown in cross section and mounted on a cabinet wall, and with the closure in an open/position.
Figure 4:
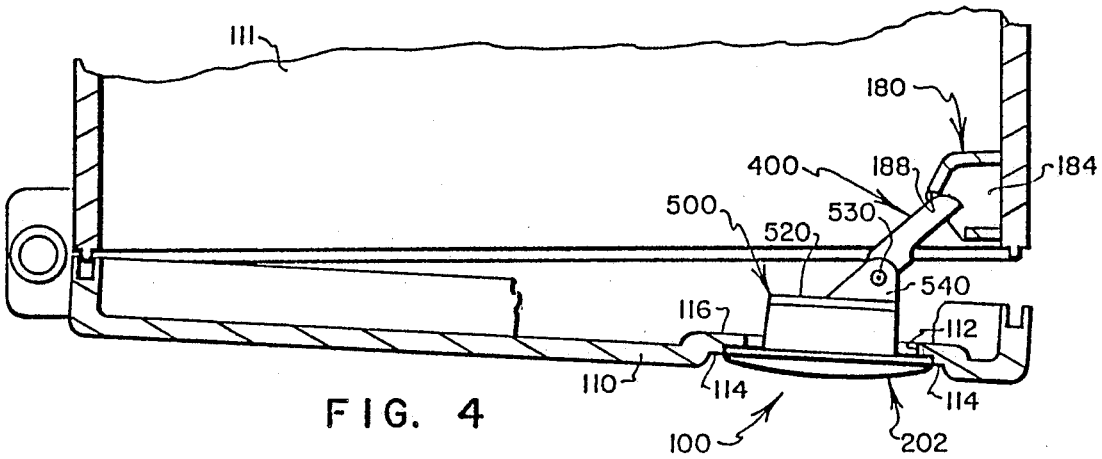
FIG 4 is a schematic top plan view similar to FIG. 3 but with the closure moved toward its closed position to bring a rearwardly projecting latch bolt of the lock assembly into engagement with the striker.
Figure 5:
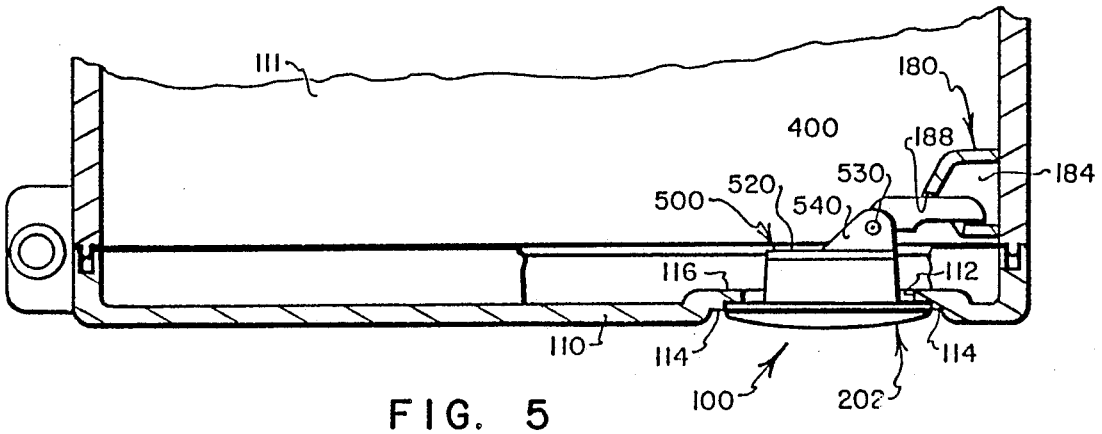
FIG. 5 is a schematic top plan view similar to FIGS. 3 and 4, but with the closure closed, and with the latch bolt in latched engagement with the striker.
Figure 6:
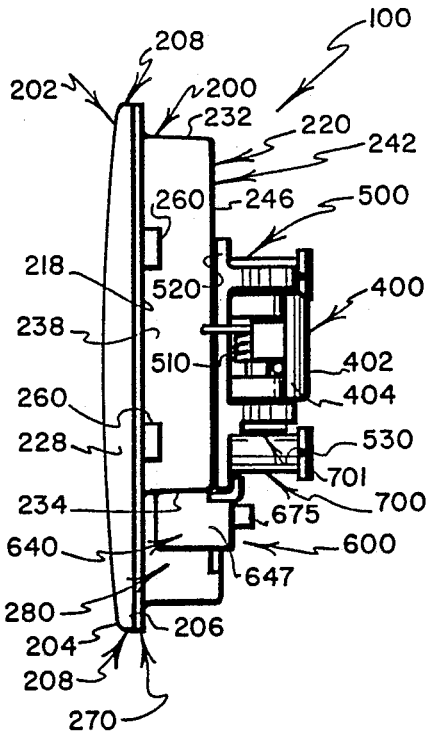
FIG. 6 is a right side elevational view showing the lock of FIG. 1, with the handle assembly in its normally nested position, with the latch bolt pivoted to its latched position, and with locking components locked.

The manner in which the latch bolt 400 of the lock assembly 100 cooperates with the striker 180 as the closure 110 is pushed to its closed position is depicted in the schematic top views of FIGS. 3–5. Referring to FIG. 3, when the closure 110 is open with respect to a cabinet structure 111 on which the closure 110 is pivotally mounted, the latch bolt 400 of the lock assembly 100 is pivoted (under the action of a torsion coil spring 510 that is shown in FIG. 2) to an unlatched position, i.e., to a position wherein the latch bolt 400 projects rearwardly and rightwardly as viewed in FIG. 3.

As the closure 110 is pivoted progressively toward its closed position, the latch bolt 400 is brought into engagement with the striker engaging surface 188 of the striker 180, as is shown in FIG. 4. Completion of the pivotal movement of the closure 110 to its closed position causes the engagement of the latch bolt 400 with the striker surface 188 to pivot the latch bolt 400 (in opposition to the action of the torsion spring 510) to the latched position of the latch bolt 400, as is shown in FIG. 5. As the latch bolt reaches its latched position, the handle assembly 300 pivots to its normally nested position (under the influence of a compression coil spring 360 that is shown in FIG. 2). When the handle assembly 300 pivots to its normally nested position, a rearwardly extending projection 320 of the handle assembly 300 moves into a position of retaining engagement with an end region 402 of the latch bolt 400 to hold the latch bolt 400 in its latched position (as is depicted schematically in FIG. 11).

Figure 12:
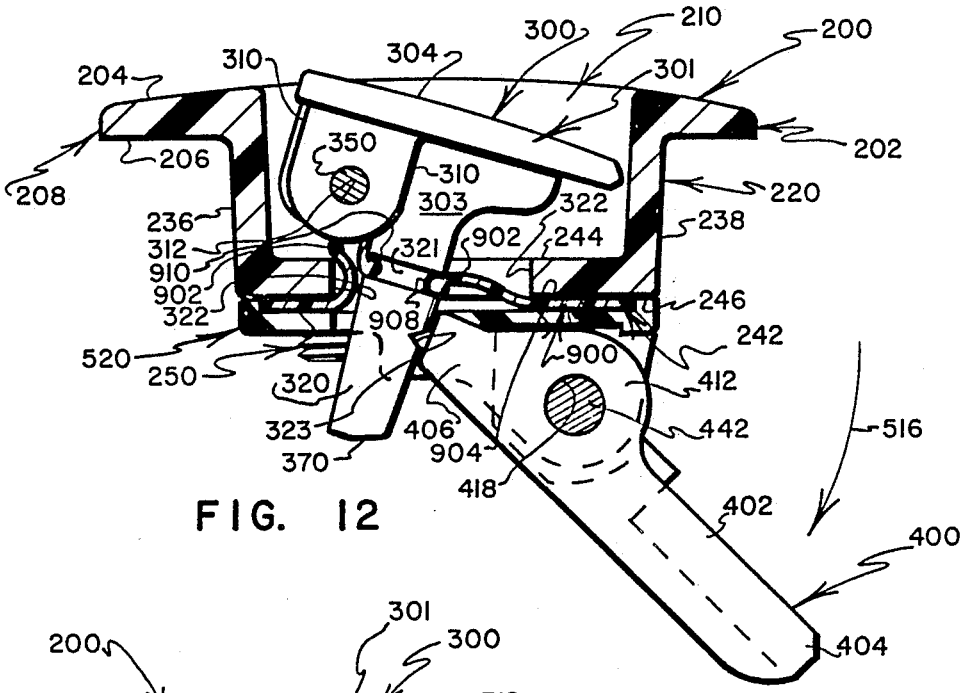
FIG. 12 is a schematic view similar to FIG. 11, but showing the handle assembly fully pivoted out of its nested position, and with the latch bolt unlatched.

Unlatching of the lock assembly 100 is effected by depressing the handle assembly 300, as is depicted schematically in FIG. 12. Pivotal movement of the handle assembly 300 to its operated position moves the projection 320 out of retaining engagement with the latch bolt end region 406, whereupon the latch bolt 400 pivots under the action of the torsion coil spring 510 to its unlatched position, as is depicted in FIG. 12. As the latch bolt 400 pivots to its unlatched position, the engagement between the latch bolt 400 and the striker surface 188 causes the closure 110 to be "popped open" to the position shown in FIG. 4.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. More extensive portions of the closure 110 are depicted schematically in FIGS. 3–5, as is associated cabinet structure 111. The closure portion 110 has a front surface 114 and a rear surface 116 that extend about the perimeter of the opening 112. As is best seen in FIG. 1, the opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting posts 700 have enlarged hexagonal head formations 701 near their rearward ends to enable the mounting posts 700 to be engaged by conventional wrenches and the like to facilitate the installation and tightening into place of the mounting posts 700. As will be explained, threaded holes 709 are formed through the mounting posts 700, thereby enabling the forward end regions of the mounting posts 700 to be threaded onto housing-carried studs 250, and enabling threaded fasteners 702 to be threaded into the rearward end regions of the mounting posts to connect the mounting bracket 750 to the housing 200.

The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. A notch 768 is formed in one side of the back wall 760 to provide a clear, unobstructed path of movement for the latch bolt 400. Appearance features of the mounting bracket 750 are disclosed in greater detail in the referenced Design Case VIII.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending extending into engagement with the rear surface 116 of the closure 110, and with the notch 768 overlying the bolt 400. Threaded fasteners 702 are installed to extend through holes 752 that are formed through the back wall 760 of the bracket 750. The fasteners 702 are threaded into the holes 709 that are formed through the mounting posts 700 of the lock assembly 100 to clamp the mounting flange 202 into engagement with the gasket 720, to clamp the gasket 720 into engagement with the front surface 114, and to clamp the legs 762, 764 into engagement with the rear surface 116.

Referring to FIGS. 1 and 2, an improvement feature of the present invention resides in the provision of optional spacers 703 that can be installed on the rearward end regions of the mounting posts 700 to increase the effective lengths of the mounting posts 700 as may be needed to accommodate a closure 110 (or other structure on which a latch or lock unit is being installed) that is of greater thickness than is accommodated by the lengths of the mounting posts 700 alone. The spacers 703 have through holes 705 that receive the threaded fasteners 702, with forward end regions of the through holes 705 being enlarged to provide hex-shaped recesses 707 that snugly receive and mate with the hex heads 701 of the mounting posts 700. By inserting a separate one of the spacers 703 on the rearward end region of each of the mounting posts 700, the effective lengths of the mounting posts 700 are increased such that, when the mounting bracket 750 is installed in engagement with the spacers 703, the mounting bracket 750 will be mounted slightly more rearwardly with respect to the mounting flange 202 of the housing 200 so that the legs 762, 764 will be farther spaced from the mounting flange 202 than would be the case if the spacers 703 were not used to extend the effective lengths of the mounting posts 700.

Figure 17:
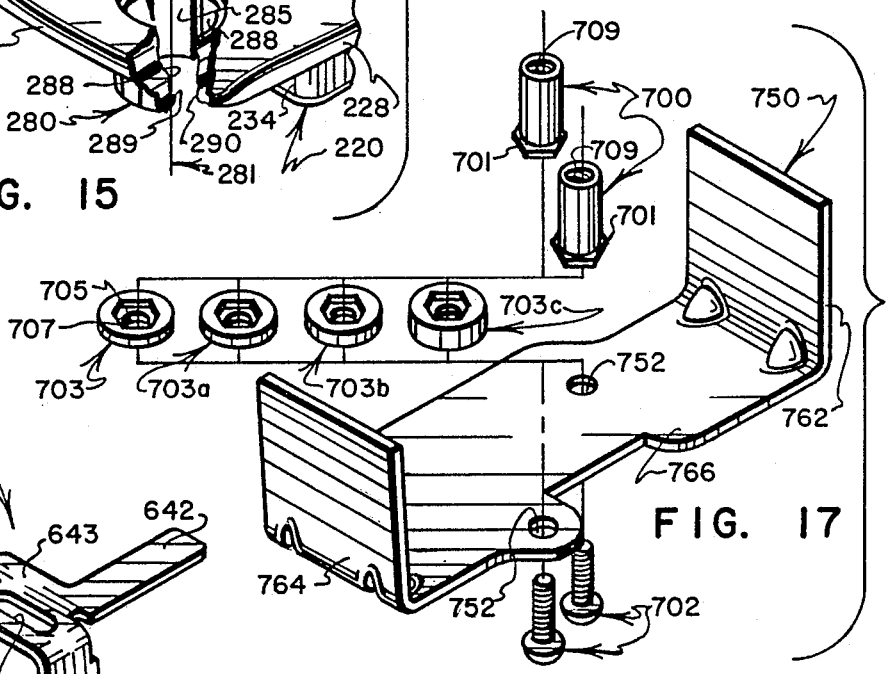
FIG. 17 is an exploded perspective view showing latch and lock assembly mounting components (including spacers of a variety of thicknesses that can be selected for use with the other depicted components) that cooperate to enable latch and lock assemblies to be installed on structures of a variety of thicknesses.

Referring to FIG. 17, spacers 703, **703*a*, 703*b*, 703*c* of a variety of thicknesses may be selectively used (in identical pairs) to extend the effective lengths of the mounting posts 700 to any desired extent, whereby the spacers 703, 703*a*, 703*b*, 703*c* enable the described type of latch and lock assemblies to be mounted on structures of substantially any given thickness. The spacers 703*a*, 703*b*, 703*c* differ from the spacers 703 only in thickness (i.e., in the extent to which they increase the effective lengths of the mounting posts 700**).

To facilitate an understanding of the various relative positions of the principal relatively movable components of the lock assembly 100, reference is made to FIGS. 1 and 6–8 wherein the components of the lock assembly 100 are arranged such that: the handle assembly 300 is in its "normal" or "nested" position; the latch bolt 400 is in its "latched" or "projected" position; and the lock mechanism 600 is "locked" so as to prevent unlatching movement of the latch bolt 400 in response to attempted operation of the handle assembly 300. In FIG. 9, the mechanism of the lock 600 is shown "unlocked" so as to permit unlatching movement of the latch bolt 400 by operation of the handle assembly 300. In FIGS. 10 and 12, the handle assembly 300 is shown in its "operating" position wherein the handle assembly 300 functions to permit the latch bolt 400 to pivot to its "unlatched" position.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing 200 as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, Mass. 01201 under the registered trademark XENOY. The most preferred resin blend is about 10 percent glass reinforced, and is selected from the "6000 Series" of the XENOY products sold by General Electric, with XENOY 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

The mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important function of mounting other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decrease progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is relatively narrow.

Figure 7:
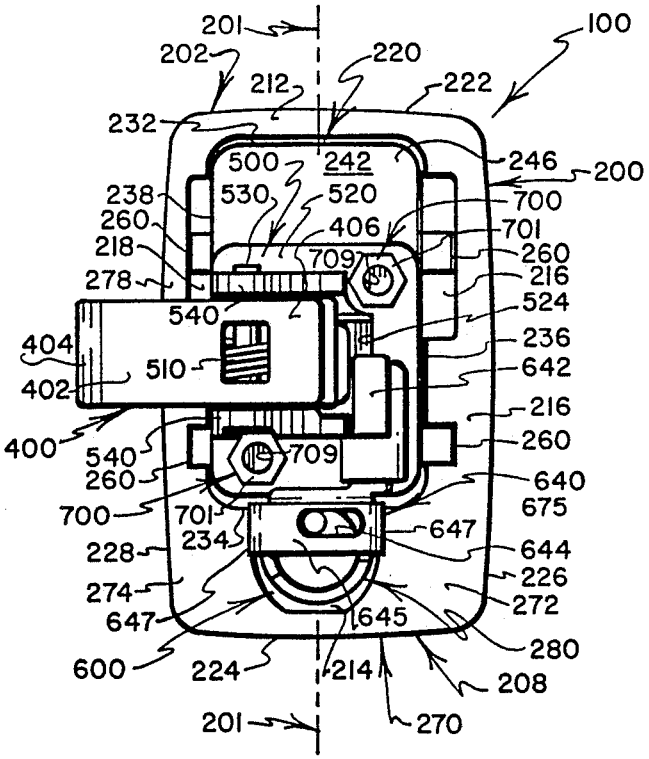
FIG. 7 is a rear elevational view thereof.

A feature of the invention resides in the provision of compact, simply configured locks and latches having pivotal latch bolts, with the functional, operating components thereof being arranged substantially symmetrically about an imaginary, vertically extending center plane designated in FIG. 7 by the numeral 201. In this regard, it will be understood that several functional features of the housing 200 are arranged substantially symmetrically about the center plane 201, including the side walls 236, 238 of the housing portion 220, and a sleeve-like housing formation 280, which will be described.

With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Figure 14:
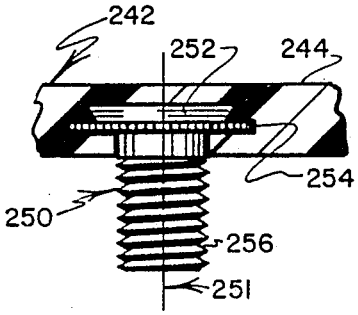
FIG. 14 is a sectional view, on an enlarged scale, as seen from a plane indicated by a line 14—14 in FIG. 2.

Threaded studs 250 project rearwardly from the rear face 246 of the back wall 242 for mounting various latch and lock components, as will be explained. Referring to FIG. 14, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the plastics material and will not rotate with respect thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

In preferred practice, the threaded studs 250 are commercially available fasteners that are sold by Penn Engineering and Mfg. Corp. of Danboro, Penna., under the trademark PEM. The preferred part is model number CHN-832-4, which is formed from stainless steel, has a tapered head 252 with a maximum diameter of about 0.289 inch, has radially extending projecting portions 254 that have a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Locator projections 260 are provided at spaced locations along the side walls 236, 238 at junctures of the side walls 236, 238 with the rear face 206 of the mounting flange 202. As will be seen in FIG. 7, the locator projections 260 are arranged symmetrically in pairs on opposite sides of the center plane 201. The locator projections 260 are intended to directly engage opposite sides 126, 128 of the opening 112 (see FIG. 1) to orient the lock assembly 100 properly on the closure 110; however, if the opening 112 has been formed so as to be slightly "oversized," the locator projections 260 may be utilized during installation of the lock assembly 100 on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

While the gasket 270 is not essential in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside-out" manner. Specifically, referring to FIGS. 1 and 2, the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large corner region 272 that is configured to underlie a correspondingly large corner portion of the bottom wall 214 of the mounting flange 202, and a relatively smaller corner region 274 that is configured to underlie a correspondingly smaller corner portion of the bottom wall 214 of the mounting flange. The character of the cut-out 275 that is defined by the gasket 270 is configured to permit the gasket 270 to suitably surround rearwardly projecting portions of the housing 200.

Figure 15:
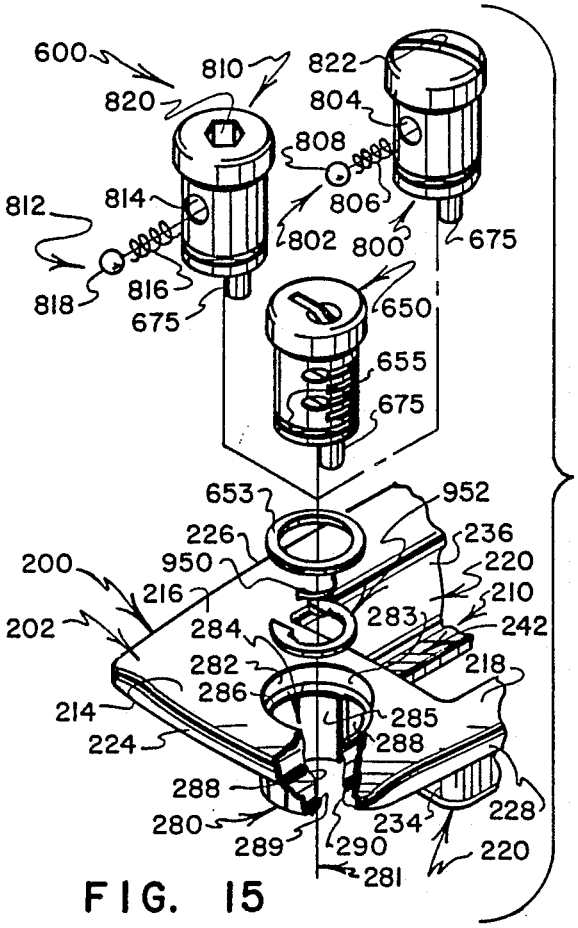
FIG. 15 is an exploded perspective view showing selected portions of the lock assembly, with alternate forms of a rotary plug that is insertable into the housing being shown.

Referring to FIGS. 2 and 15, the sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 that lies within the imaginary center plane 201 (see FIG. 7) and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figure 19:
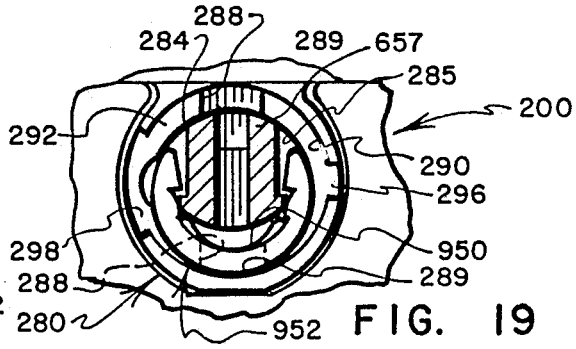
FIG. 19 is a sectional view showing the components of FIG. 18 and including sleeve portions of a lock housing, as seen from a plane indicated generally by a line 19—19 in FIG. 8, and with the clip projecting from the groove of the rotary plug in which the clip is carried so as to cooperate with an end wall portion of the sleeve to retain the rotary plug within the sleeve; and, FIG. 20 is a perspective view of a locking member that is employed in the lock assembly of FIG. 1.

In FIGS. 15 and 19, features of the sleeve formation 280 are shown on an enlarged scale. Referring to FIG. 15, at a location near the forward end region of the passage 284, a shoulder 286 extends substantially radially with respect to the axis 281 to form a transition between a relatively large diameter front end region 283 of the passage 284 (which defines the opening 282) and a relatively smaller diameter central portion 285 of the passage 284. Axially extending top and bottom grooves 288 are formed in opposed upper and lower portions of the passage 284. The grooves 288 extend axially rearwardly from the shoulder 286 and have bottom walls 289 that are curved and represent continuations of a cylindrical surface 290 (see also FIG. 19) of enlarged diameter that is formed in the rearward end region of the sleeve 280.

Referring to FIG. 19, a radially extending shoulder 292 forms a transition between the reduced diameter of the central passage 285 and the enlarged diameter of the rearward end region 290. The shoulder 292 provides a circumferentially extending "end wall" that is located near the rearward end region of the sleeve formation 280. As will be explained later, the end wall 292 is engaged by and cooperates with a a retaining clip 680 to secure a rotary plug (such as the key cylinder 650) in the passage 284. While two opposed portions 296, 298 of the shoulder 292 extend radially outwardly and interrupt opposed side portions of the sleeve formation 280, these features are not made use of in the preferred practice of the present invention (however, these features are utilized in the preferred practice of the invention that forms the subject matter of the referenced Predecessor Case).

Referring to FIGS. 1, 2, and 3, it will be understood that, in preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. Depending on the type of handle that is to be used with the housing 200, and on the type of latch or lock operating mechanism that is to be mounted on the housing 200, one or more suitable passages (such as a back wall opening 322 depicted in FIGS. 11–13) through the housing 200 are machined to provide openings, holes, slots and the like, as may be needed, which formed as by drilling, milling or other conventional machining techniques.

Figure 13:
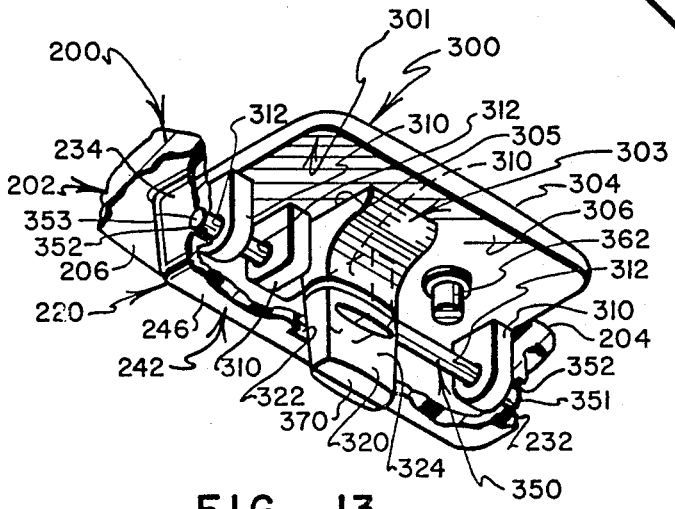
FIG. 13 is a perspective view of portions of the handle assembly and the housing, with housing portions broken away, with the handle assembly in its normal nested position with respect to the housing, and with the view showing principally rear features thereof.

Referring to FIGS. 2 and 13, the handle assembly 300 includes a forward component 301 and a rearward component 302 that are formed from molded plastics material, preferably of the same thermoplastics material from which the housing 200 is formed. The forward component 301 defines forwardmost portions of the handle assembly 300. The rearward component 303 abuttingly engages the forward component 301 and is rigidly connected to the forward component 301, as will be explained. By utilizing the two separately molded components 301, 303 to form the basic structure of the handle 300 (which is in contrast to the single component that is utilized to form a handle of very similar configuration for use with the invention embodiment that is described in the referenced Predecessor Case), the relatively complex shape of the handle 300 is rendered easier to mold.

The forward handle component 301 has a front surface 304 that is of complexly curved, generally convex shape, and is configured to extend in a flush, substantially contiguous manner to smoothly continue the curvature of the complexly curved, convex front surface 204 of the mounting flange 202 when the handle assembly 300 is in its normal or nested position. The handle component 301 has a back wall surface 306. As is best seen in FIG. 13, four projecting formations 310 extend rearwardly from the back wall surface 306 at spaced intervals therealong, with a central pair of the formations 310 defining a space therebetween that snugly receives the rearward handle component 303. The rearward handle component 303 has a front surface 305 (see FIG. 2) that abuttingly engages the back wall surface 306 of the forward handle component 301.

Aligned holes 312 are formed through the rearwardly projecting formations 310 of the forward component 301, and through the forward end region of the rearward component 303 to receive a mounting pin 350. The mounting pin 350 extends through the aligned holes 312 in a slip fit that enables the handle components 301, 303 to pivot as a unit about the axis of the pin 350. By this arrangement, the pin 350 serves the dual functions of rigidly interconnecting the handle components 301, 303, and of mounting the handle components 301, 303 for pivotal movement relative to the pin 350 about the axis of the pin 350.

Referring to FIGS. 2 and 13, the mounting pin 350 preferably is formed from stainless steel stock, and has opposed end regions 351, 353 that are received in aligned holes 352 (one is shown in FIG. 2) that are formed in the end walls 232, 234 of the housing 200. The end region 351 is provided with a plurality of raised rib-like flutes 355 that are configured to seat tightly in one of the housing holes 352 so as to retain the mounting pin 350 in place so that the mounting pin 350 neither moves axially nor rotates relative to the housing 200. By this arrangement, the mounting pin 350 supports the handle components 301, 303 for pivotal movement relative to the housing 200 between a normally nested position that is, shown in FIGS. 1, 5–9, 11 and 13 and an operating position that is depicted in FIGS. 10 and 12. As is depicted in the drawings, the forward component 301 of the handle assembly 300 has a generally rectangular shape and a size that lets the component 301 nest and move with ease within the confines of the recess 210.

Figure 11:
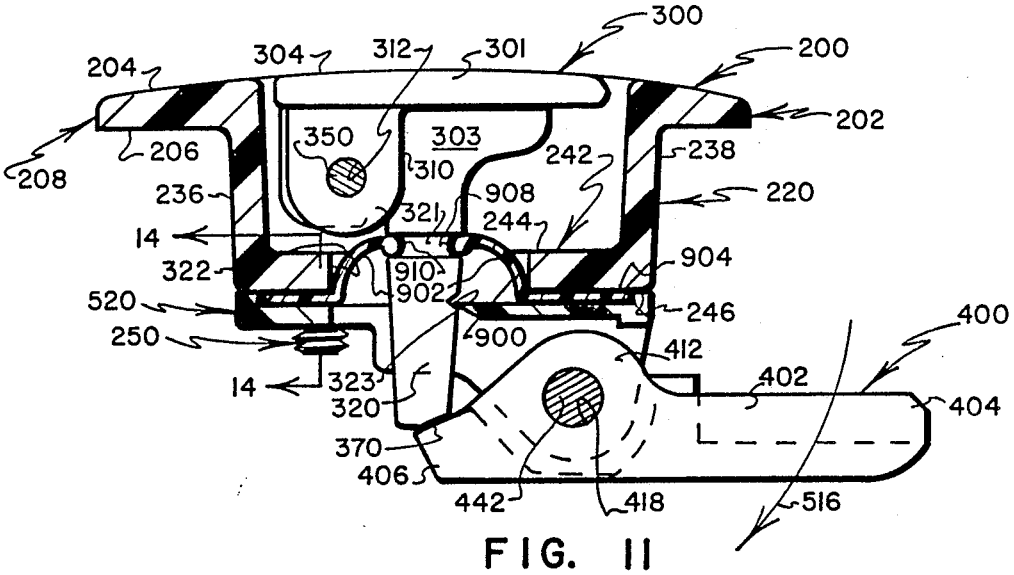
FIG. 11 is a schematic view, partially in cross section, on an enlarged scale, showing the handle assembly in its normal nested position in relation to the housing, and showing the latch bolt latched, with the latch bolt being held in its latched position by its engagement with a rearwardly projecting portion of the handle assembly.

The rearward component 303 has a rearwardly extending projection 320 that is of substantially elliptical cross section and that extends through an opening 322 that is formed in the back wall 242 of the housing 200. When the handle assembly 300 is in its nested position, the projection 320 extends substantially centrally through the opening 322, as is shown in FIG. 11. When the handle assembly 300 is in its operated position, the projection 320 resides near to (but is spaced from) one side of the opening 322, as is shown in FIG. 12. By this arrangement, central portions 902 of a resilient boot type seal 900 can extend into the opening 322 and into surrounding relationship with the projection 320 to form a weather resistant seal between the housing 200 and the handle assembly 300 and to thereby prevent the passage of unwanted moisture through the opening 322. For purposes of receiving and matingly engaging central portions 902 of the boot 900, a perimetrically extending groove 321 is formed about the projection 320. An additional groove 323 of a V-shaped type extends across one side of the projection 320 at a location that is rearward with respect to the location of the groove 321 to provide clearance for proper side to side movement of the projection 320 as the handle assembly 300 is pivoted between its nested and operated positions.

Referring to FIGS. 2, 11 and 12, the resilient boot type seal 900 has a flat, generally rectangular rim portion 904 that surrounds the more bulbous central portion 902. A pair of holes 906 are formed through opposed corner regions of the rim portion 904. A generally elliptical opening 908 is formed through the central portion 902 to receive and sealingly mate with the projection 320. As is best seen in FIGS. 11 and 12, an enlarged rib 310 defines the opening 308 and extends snugly into the groove 321. The boot seal 900 preferably is formed as a water impervious membrane of a resilient material such as ethylene propylene having a thickness of at least about 0.025 inches and a durometer of about 80. The rim portion 904 of the boot seal 900 is clamped between the back wall 242 of the housing 200 and overlying portions of a mounting plate 520 to hold the boot seal 900 in place, as will be explained.

A compression coil spring 360 (see FIG. 2) is interposed between the back surface 306 and the back wall 242. One end region of the spring 360 is wrapped tightly about a projection 362 (see FIG. 13) that extends rearwardly from the back surface 306. The spring 360 biases the handle assembly 300 toward its nested position.

As is best seen in FIGS. 11 and 12, the handle projection 320 has an end portion 370 that is engageable with the bolt 400 either to retain the bolt 400 latched (as is shown in FIG. 11) or to release the bolt 400 for movement to is unlatched position (shown in FIG. 12).

The latch bolt 400 is connected to the housing 200 by means of mounting plate and spring assembly 500 that is mounted on the back wall 242 of the housing 200 by the mounting posts 700. The latch bolt 400 is movable between a latched position (shown in FIGS. 1, 5–9 and 11) and an unlatched position (shown in FIGS. 10 and 12).

Referring to FIGS. 2, 11 and 12, the latch bolt 400 is an elongate member of generally rectangular configuration having a left end region 406 that is engageable, with the handle projection 320, a right end region 404 that is engageable with the striker surfaces 188, 198, and a central region 410 that interconnects and extends between the end regions 404, 406. A pair of mounting formations 412 are provided on the central region 410. The mounting formations 412 border opposite sides of a slot 414 that is formed through the mounting plate within which a torsion coil spring 510 is carried.

Referring to FIG. 2, the torsion coil spring 510 and the mounting plate 520 are connected to the latch bolt 400 by means of a pivot pin 530. The pivot pin 530 extends through aligned holes 418 formed in the mounting formations 412, through coils of the spring 510, and through aligned holes 542 that are provided in a pair of upstanding mounts 540 that are formed integrally with the mounting plate 520.

The mounting plate 520 preferably is formed from the same thermoplastic material that is used to form the housing 200 and the handle assembly 300. The mounting plate 520 has a rim 521 that is configured to be clamped into engagement with the back wall 242 of the housing 200. The rim 521 surrounds a forwardly facing wall 523 and cooperates with the wall 523 to define a recess that is configured to receive the rim portion 904 of the boot seal 900. Holes 522 are formed through the wall 523 to receive the threaded studs 250. The mounting posts 700 have cylindrical portions 703 that extend for a short distance into enlarged rearward end regions of the holes 522 as the mounting posts 700 are threaded onto the studs 250 to clamp the mounting plate 520 in place on the housing 200 (and to thereby clamp the rim portion 904 of the boot seal 900 between the wall surfaces 523, 242 to hold the boot seal 900 in place.

Figure 16:
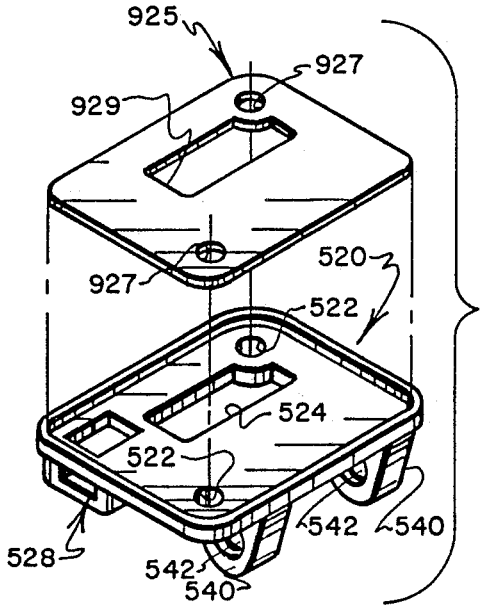
FIG. 16 is an exploded perspective view showing a mounting plate and a shim member that is insertable into a recess that is defined by the mounting plate, it being understood that the shim member is installed in the recess only in the event that no resilient boot (of the type that is shown in FIGS. 2, 11 and 12) is installed in the mounting plate recess.

Referring to FIG. 16, if no boot seal 900 is to be used with the lock assembly 100, a shim member 925 is provided to effectively fill the recess that is defined by the rim 521 and the wall 523. The shim member 925 has suitable holes 927 and a central opening 929 formed therethrough to receive the threaded studs 250 and the rearwardly extending handle projection 320.

Referring once again to FIG. 2, a passage 524 is formed through the central region of the mounting plate 520 in alignment with the back wall opening 322 to receive the handle projection 320. The torsion spring 510 has opposite ends 512, 514 in engagement with the mounting plate 520 and the bolt 400 to bias the bolt in the direction of the arrow 516 as shown in FIGS. 11 and 12. When the latch bolt 400 is in its latched position, the end 402 of the latch bolt 400 is engaged by the end 370 of the handle projection 320 and is thereby held securely in its latched position. When the handle assembly 300 is pivoted (as is shown in FIG. 12) to its operated position, the end 370 of the projection 320 disengages the latch bolt 400, and the latch bolt 400 pivots to its unlatched position under influence of the torsion coil spring 510. As the latch bolt 400 pivots to its latched position, the engagement between the latch bolt 400 and the striker surface 188 (see FIGS. 3–5) will cause the closure 110 to be forced open with something of a pop-open type of action.

Figure 8:
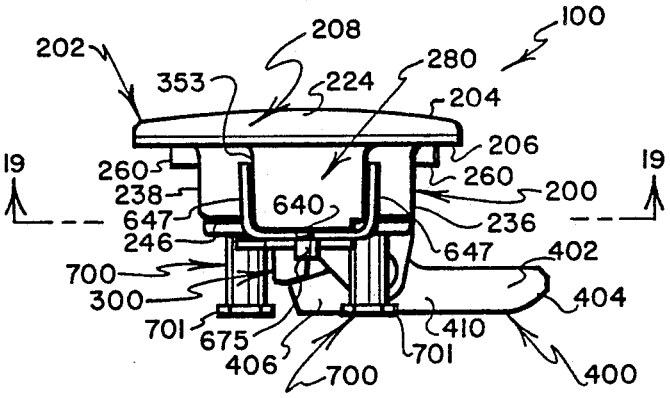
FIG. 8 is a bottom plan view thereof.
Figure 9:
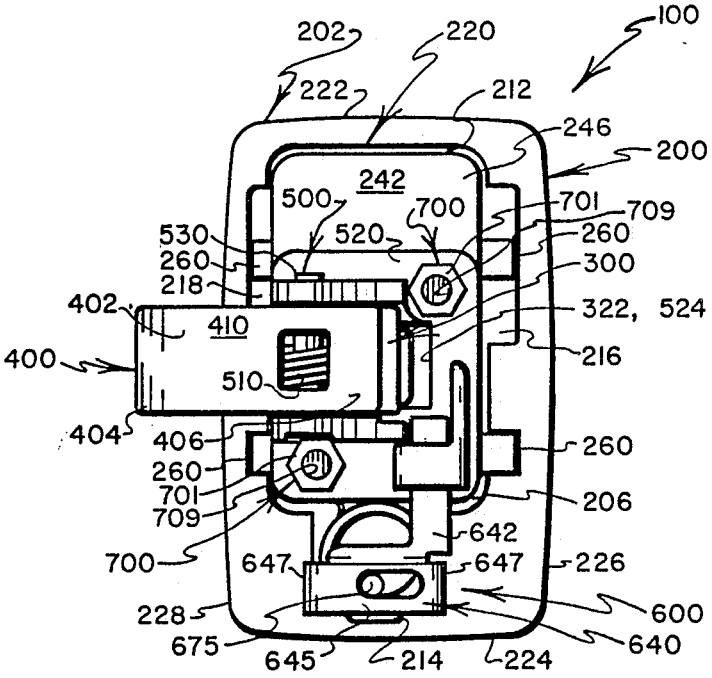
FIG. 9 is a rear elevational view similar to FIG. 7 but with the locking components unlocked.
Figure 10:
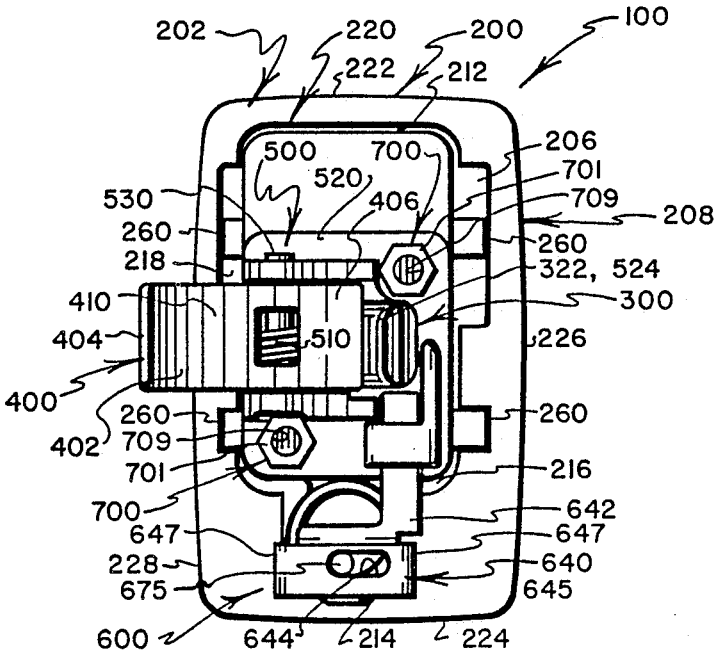
FIG. 10 is a rear elevational view similar to FIG. 9 but with the latch bolt pivoted to its unlatched position, and with the handle assembly being held out of its nested position by the latch bolt.
Figure 20:
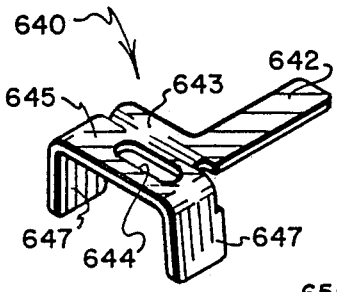

Referring to FIGS. 2 and 7–10, the locking system 600 includes a locking member 640 that is slidably carried by the mounting plate 520 for movement between a locked position that is shown in FIGS. 7 and 8, and an unlocked position that is shown in FIGS. 9 and 10. Referring to FIGS. 2 and 20, the locking member 640 has a generally U-shaped base portion 641 that is connected by a dog-legged formation 643 to an elongate stem portion 642. The stem portion 642 is slidably carried in a slide channel 528 that is defined by an opening 529 that is formed through a raised portion 531 of the mounting plate 520 (see FIG. 2). When the locking system 600 is locked, the stem portion 612 of the stem portion 642 of the locking member 640 overlies a portion of the opening 524 (as is shown in FIG. 7) to prevent the handle projection 320 from moving out of its latched position. When the locking member 640 is moved to its unlocked position (shown in FIG. 9), the stem portion 642 no longer blocks movement of the handle projection 320 within the opening 524, and the handle assembly 300 therefor can be operated to effect unlatching movement of the latch bolt 400.

Referring to FIGS. 2 and 20, the base portion 641 of the locking member 640 has a central part 645 that overlies the rear end of the sleeve formation 280 of the housing 200, and a pair of opposed arms 647 that extend forwardly so as to embrace opposite sides of the sleeve formation 280 in a slip fit (as is best seen in FIG. 8). By this arrangement, the arms 647 cooperate with the sleeve formation 280 to help guide the movement of the locking member 640 between its locked and unlocked positions. Moreover, the embracing engagement that is provided by the arms 647 with the sleeve formation 280 enhances the secure locking action of the assembly 100 in that the locking member 640 is prevented from being forced out of position in a manner that might defeat its locking function.

An elongate slot 644 is formed in the base portion 641 of the locking member 640 to receive an offset projection 675 that is provided on the rearward end region of the key cylinder 650. By this arrangement, a driving connection is established between the key cylinder 650 and the locking member 640 that enables key cylinder 650, when rotated 180 degrees within the passage 284 of the sleeve formation 280 of the housing 200, to move the locking member 640 between its locked and unlocked positions. A comparison of the relative component positions depicted in FIGS. 7 and 9 shows how a 180 degree rotation of the key cylinder 650 is operative to effect locking and unlocking movements of the locking member 640.

Figure 18:
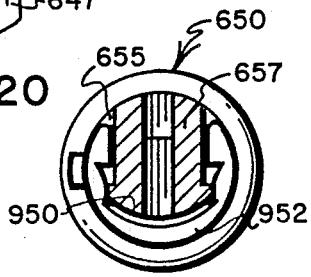
FIG. 18 is a sectional view, on an enlarged scale, showing a spring-biased retaining clip that is carried in a groove that is provided in rotary plugs of the type that are depicted in FIG. 15, with the clip shown fully radially inserted in opposition to the action of an associated leaf spring that also is carried in the groove.

Referring to FIGS. 2, 15, 18 and 19, the manner in which the key cylinder assembly 650 is installed in the housing opening and passage 282, 284 is to first install a washer-like ring 653 onto the body of the key cylinder assembly at a location near its enlarged forward end region 651, and thence to insert a leaf spring 950 and a retaining clip 952 into a groove 655 that is provided near the rearward end region of the key cylinder assembly. Referring to FIGS. 18 and 19, the groove 655 is configured to matingly receive the U-shaped retaining clip 952 with the leaf spring 950 interposed between a central portion 657 of the key cylinder and the retaining clip 952 to bias the retaining clip 952 radially outwardly with respect to the groove 655. By this arrangement, the retaining clip 952 can be depressed into the groove 655 in opposition to the action of the spring 950 to enable the key cylinder 650 to be inserted through the opening 282 into the central portion 285 of the passage 284; however, when the groove 655 passes rearwardly beyond the end wall 292 of the sleeve formation 280, the action of the spring 950 will force portions of the retaining clip 952 to move radially outwardly to the position illustrated in FIG. 19 so as to overlie portions of the end wall 292 and to thereby retain the key cylinder 650 within the passage 284. Those skilled in the art are familiar with this type of key cylinder retention system, for it is not novel and has been relatively widely utilized in a variety of commercially available lock embodiments.

Referring to FIG. 15, in place of the key cylinder assembly 650, it is possible to employ other forms of rotary plugs, such as the depicted plug members 800, 810. The plug members 800, 810 have substantially the same general shape as the key cylinder assembly 650 and therefore can be installed in the opening and passages 282, 284 to function like the key cylinder assembly 650 except that no key is required to effect their rotation. Instead, a tool receiving formation such as a hex driver receiving opening 820, or a flat groove 822 for receiving a screwdriver blade is provided in outer end regions of the plug members 800, 810 as is depicted in FIG. 15.

Ball detents 802, 812 can be provided in the plug members 800, 810 as by forming radially extending passages 804, 814 into which are inserted compression coil springs 806, 816 and balls 808, 818. The balls 808, 818 are operative to engage the grooves 288 to prevent unwanted rotary movement of the plugs 800, 810.

Although the invention has been described in its preferred form with a certain degree of particularity, it is understood that the present disclosure of the preferred form has been made only by way of example, and that numerous changes in details of construction as well as the combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A flush-mountable latch, comprising:

(a) housing means including a pan-shaped housing having a front wall, and having recess-defining wall formations that define a forwardly facing recess, with portions of the front wall forming a mounting flange that surrounds the recess;

(b) the housing being formed as a rigid, one-piece molded structure with the recess-defining wall formations including a back wall at the rear of the recess, with the back wall defining a rearwardly facing mounting surface;

(c) threaded fastener means rigidly connected to the back wall at spaced locations, including two threaded fasteners located near opposed sides of the mounting surface;

(d) handle means including a push-to-operate handle, and handle mounting means pivotally connecting the handle to the housing for movement relative to the housing between a non-operated position wherein the handle extends substantially flush with the front wall, and an operated position wherein at least a selected portion of the handle is pivoted inwardly with respect to the recess and toward the back wall of the housing;

(e) opening means formed through the recess-defining wall formations of the housing to establish a path of communication between the forwardly facing recess and a region that is located behind the back wall, including an opening that is formed through the back wall and opens through the mounting surface at a location between the two threaded fasteners;

(f) the handle means additionally including handle projection means for being rigidly connected to the handle for pivotal movement therewith, including structure projecting rearwardly relative to the handle for extending through the opening means, for extending into said region located behind the back wall, and for being moved within said region in response to movement of the handle between its non-operated and operated positions;

(g) handle biasing means interposed between the handle means and the housing means for biasing the handle away from its operated position toward its non-operated position, with the housing means, the handle means and the handle biasing means cooperating to define a first spring-biased assembly;

(h) housing bracket means for engaging the mounting surface of the back wall and for defining two spaced mounting formations that extend rearwardly from the back wall;

(i) latch bolt means including an elongate latch bolt that has a central region that extends between the rearwardly extending mounting formations, and latch bolt mounting means pivotally connecting the latch bolt to the rearwardly extending mounting formations for movement relative to the housing bracket means between latched and unlatched positions, with the elongate latch bolt having opposed end regions that are interconnected by the central region;

(j) latch bolt biasing means interposed between the latch bolt means and the housing bracket means for biasing the latch bolt away from its latched position toward its unlatched position, with the housing bracket means, the latch bolt means and the latch bolt biasing means cooperating to define a second spring-biased assembly;

(k) securing means for threadedly engaging the threaded fastener means so as to clamp the housing bracket means into engagement with the mounting surface to rigidly connect the first and second spring-biased assemblies such that one end region of the elongate latch bolt extends into overlying relationship with the opening that is formed in the back wall whereby, when the handle is in its non-operated position and the latch bolt is in its latched position, the handle projection means directly engages the one end region of the latch bolt to releasably retain the latch bolt in its latched position in opposition to the action of the latch bolt biasing means, and whereby, when the handle is pivoted to its operated position in opposition to the action of the handle-biasing spring, the handle projection means does not obstruct pivotal movement of the latch bolt toward its unlatched position under the influence of the latch bolt biasing spring; and, (l) interengageable formation means carried on the handle projection means and on the one end of the latch bolt for permitting the handle to move to its non-operated position under the influence of the handle biasing means only when the latch bolt is in its latched position.

2. The latch of claim 1 wherein:

(a) the handle and the handle projection means are formed as separate components that are configured to abuttingly engage each other, and that have holes formed therethrough that align along a common axis when the separate components are engaged;

(b) the handle mounting means includes an elongate pin that extends through the aligned holes of the separate components to rigidly interconnect the separate components; and, (c) the housing has hole formation means including a pair of pin receiving holes for receiving opposed end regions of the elongate pin for pivotally mounting the separate components of the handle means on the housing means for concurrent pivotal movement about said common axis relative to the housing.

3. The latch of claim 2 wherein the elongate pin includes radially projecting formation means near one of its opposed end regions for being pressed into rigid engagement with the material of the housing that surrounds a selected one of the pin receiving holes for rigidly connecting the elongate pin to the housing means.

4. The latch of claim 2 wherein:

(a) the handle has a plurality of rearwardly extending formations at spaced locations;

(b) the handle projection means is configured to be received between two of the rearwardly extending formations; and, (c) the aligned holes include holes that are formed through the rearwardly extending formations to receive the elongate pin.

5. The latch of claim 2 wherein the housing, the handle and the handle projecting means are formed from an injection molded, glass reinforced, polycarbonate based polymer blend thermoplastics material.

6. The latch of claim 1 wherein the handle projection means includes a rearwardly extending formation that extends through the forwardly facing recess that is defined by the housing means, and the latch additionally includes resilient boot means that is clampingly engaged between portions of the housing bracket means and the housing means, with a portion of the resilient boot means extending through the opening means and into the forwardly facing recess in surrounding engagement with the rearwardly extending formation of the handle projection means for preventing the passage through the recess of excessive ambient moisture.

7. The latch of claim 6 wherein the rearwardly extending formation of the handle projection means that is engaged by the resilient boot means within the forwardly facing recess is of generally elliptical cross section.

8. The latch of claim 6 wherein the housing bracket means defines a boot receiving recess that cooperates with the mounting surface of the back wall to receive and clampingly engage the resilient boot means to securely mount the resilient boot means at a location extending about the perimeter of the opening means.

9. The latch of claim 6 wherein the resilient boot means is formed from a membrane of water impermeable ethylene propylene.

10. The latch of claim 1 wherein the latch bolt mounting means includes pivot pin means for extending through aligned holes that are formed in the two rearwardly extending formations of the housing bracket means and in the latch bolt means so as to pivotally connect the latch bolt to the housing bracket means.

11. The latch of claim 10 wherein the latch bolt biasing means includes a torsion coil spring having portions thereof extending around the pivot pin means, and having opposed end regions engaging the housing bracket means and the latch bolt, respectively, for biasing the latch bolt toward its unlatched position.

12. The latch of claim 1 wherein the handle biasing means includes a compression coil spring that is interposed between the handle and the housing for biasing the handle toward its non-operated position, with the spring having opposed end regions, with one of the end regions being connected to the handle, and with the other of the end regions engaging the back wall of the housing.

13. The latch of claim 1 wherein:

(a) the housing has a generally cylindrical sleeve-like portion formed integrally with the front wall and defining a through passage that opens through the front wall, with the through passage having an inner wall surface that is of generally cylindrical configuration and extends concentrically about an imaginary axis that extends substantially perpendicularly to the common plane of with the through passage being terminated at is rearward end by an end wall that extends substantially parallel to the common plane of the mounting flange surface portions, and with the through passage having an enlarged diameter portion that opens through the front wall;

(b) a plug of generally cylindrical configuration having an enlarged diameter forward end region that is configured to be received in a slip fit within the enlarged diameter portion of the through passage, having a central body portion that is configured to be received in a slip fit within such portions of the through passage as are located rearwardly relative to the forward end region, and having a rearward end region that is configured to extend rearwardly beyond the through passage when the plug is journaled in the through passage with its forward end region journaled in the forward end region of the through passage;

(c) a radially outwardly facing groove is formed in the rearward end region of the plug and is configured to open adjacent the end wall when the plug is journaled in the through passage; and, (d) radially outwardly biased retaining means is carried in the groove for being compressed radially into the groove to enable the plug to be inserted into the through passage, and for projecting radially outwardly of the groove once the plug has been inserted sufficiently into the passage to position the groove adjacent the end wall, whereby the outwardly biased retaining means cooperates with the end wall to retain the plug within the through passage.

14. The latch of claim 13 wherein:

(a) the housing bracket means defines a slide channel that extends alongside the opening that is formed through the back wall;

(b) the handle projecting means is configured so as to reside toward one side of the back wall opening when the handle is nested, and to reside toward an opposite side of the back wall opening when the handle is moved to its operated position;

(c) a locking member is positioned in the slide channel and is movable between locked and unlocked positions, with the locking member being configured such that when it is in its locked position it blocks movement of the handle projecting means from the one side to the other side of the back wall opening, whereby the locking member blocks movement of the handle to its operated position when the locking member is in its locked position;

(d) the locking member has a portion that extends behind the plug and has an elongate opening formed through such portion, with the elongate opening extending in a direction that is transverse to the path of movement of the locking member in the slide channel;

(e) a rearwardly extending projecting portion of the plug extends through the elongate opening of the locking member and cooperates with the elongate opening to define a driving connection between the plug and the locking member that enables the plug to move the locking member between its locked and unlocked positions; and, (f) the locking member has spaced, opposed portions that extend along opposed sides of the generally cylindrical sleeve-like portion to receive the sleeve-like portion therebetween, whereby the sleeve-like portion and the opposed portions of the locking member cooperate with the structure that defines the slide channel to guide the movement of the locking member between its locked and unlocked positions.

15. The latch of claim 1 additionally including striker means configured to engage the latch bolt when a pivotally mounted closure on which the latch is mounted is moved toward its closed position wherein the latch bolt is brought toward a position of engagement with the striker means;

(a) the striker means including structure defining a latch bolt engagement surface for engaging the latch bolt as the latch bolt approaches the striker means during closing of the door, and for effecting rotation of the latch bolt from its unlatched to its latched position in response to complete movement of the closure to its closed position; and, (b) the striker means having formation means for releasably retaining the latch bolt in its latched position once the latch bolt has been received by the striker means and has moved to its latched position as the closure has completed its movement to its closed position.

16. The latch of claim 1 wherein:

(a) the securing means for threadedly engaging the threaded fastener means includes elongate tubular sleeve means having internally threaded openings formed therethrough, with the threaded openings thereof each having a forward end region for being threaded onto the threaded fastener means, and having a rearward end region that opens rearwardly;

(b) mounting bracket means is provided for overlying rearward portions of the latch including the elongate tubular sleeve means, and for extending into engagement with a rearward surface of structure onto which the latch is to be mounted; and, (c) auxiliary threaded fastener means is provided for being threaded into the rearwardly end regions of the threaded openings for connecting the mounting bracket means to the elongate tubular sleeve means.

17. The latch of claim 16 additionally including spacer means for being imposed between the rearward end regions of the elongate tubular sleeve means and the mounting bracket means for positioning the mounting bracket means at a predetermined distance behind the elongate tubular sleeve means, and with the spacer means having hole formation means therethrough for receiving the auxiliary threaded fastener means so as to secure the spacer means in position between the elongate tubular sleeve means and the mounting bracket means.

18. The latch of claim 17 wherein enlarged hexagonal head formations are provided on the rearward end regions of the elongate tubular sleeve means, and the hole formation means have enlarged forward end regions that are configured to matingly receive the enlarged hexagonal head formations to assist in retaining the spacer means in position.

19. A flush-mountable latch, comprising:

(a) a pan-shaped housing having a front wall, recess-defining wall formations that define a forwardly facing recess, with portions of the front wall forming a mounting flange that surrounds the recess, and with the housing having a locking plug mounting location defined at one end of the recess by a sleeve-like structure that has a through passage that opens through the front wall;

(b) the housing being formed as a rigid, one-piece structure from injection molded material, with the recess-defining wall formations including a back wall at the rear of the recess, with the back wall defining a rearwardly facing mounting surface, with two threaded mounting studs having portions embedded in the material of the back wall and having threaded stud portions that project rearwardly from the back wall at spaced locations near opposite side portions of the mounting surface;

(c) handle means including an operating handle, and handle mounting means for pivotally connecting the handle to the housing for movement relative to the housing from a nested position wherein the handle extends substantially flush with the front wall to an operated position;

(d) opening means formed through recess-defining wall formations of the housing to establish a path of communication between the forwardly facing recess and a region located outside the recess and behind the back wall, including an opening that is formed through the back wall and that opens through the mounting surface at a location between the two threaded mounting studs;

(e) handle-connected means for extending through the opening means, for extending into said region located behind the back wall, and for being moved within said region in response to movement of the handle between its nested and operated positions;

(f) bolt means located behind the back wall and being responsive to movement of the handle-connected means by the handle means to releasably latchingly engage structure located in spaced relationship with the latch;

(g) bolt mounting means for movably connecting the bolt means to the back wall for supporting the bolt means on the housing, including structure that has a pair of holes formed therethrough to received the two threaded mounting studs, and elongate sleeve means including a pair of internally threaded, elongate sleeve members for being threaded onto the threaded mounting studs to assist in establishing a secure connection with the back wall;

(h) mounting bracket means for overlying rearward portions of the latch including the elongate sleeve means, and for extending into engagement with a rearward surface of structure onto which the latch is to be mounted; and, (i) auxiliary threaded fastener means for being threadedly connected to the elongate sleeve means for connecting the mounting bracket means to the elongate tubular sleeve means.

20. The latch of claim 19 additionally including spacer means for being imposed between the elongate sleeve means and the mounting bracket means for positioning the mounting bracket means at a predetermined distance behind the elongate sleeve means, and with the spacer means having hole formation means therethrough for receiving the auxiliary threaded fastener means so as to secure the spacer means in position between the elongate sleeve means and the mounting bracket means.

21. The latch of claim 20 wherein enlarged hexagonal head formations are provided on rearward end regions of the elongate sleeve means, and the hole formation means have enlarged forward end regions that are configured to matingly receive the enlarged hexagonal head formations to assist in retaining the spacer means in position on the elongate sleeve means.

* * * * *